United States Patent [19]

Donovan et al.

[11] Patent Number: 4,992,327

[45] Date of Patent: Feb. 12, 1991

[54] SYNTHETIC DOWN

[75] Inventors: James G. Donovan, Norwell; Zivile M. Groh, Sharon, both of Mass.

[73] Assignee: Albany International Corp., Albany, N.Y.

[21] Appl. No.: 157,945

[22] Filed: Feb. 19, 1988

Related U.S. Application Data

[63] Continuation-in-part of Ser. No. 17,472, Feb. 20, 1987, abandoned.

[51] Int. Cl.[5] ..... B32B 5/06; D02G 3/00

[52] U.S. Cl. ..... 428/296; 428/198; 428/288; 428/360; 428/362; 428/369; 428/401

[58] Field of Search ..... 428/198, 280, 288, 283, 428/296, 357, 359, 361, 360, 362, 369, 373, 374, 401, 903

[56] References Cited

U.S. PATENT DOCUMENTS

| | | | |
|---|---|---|---|
| 4,118,531 | 10/1978 | Hauser | 428/369 X |
| 4,304,817 | 12/1981 | Frankosky | 428/361 |
| 4,520,066 | 5/1985 | Athey | 428/369 X |
| 4,551,378 | 11/1985 | Carey, Jr. | 428/198 |
| 4,588,635 | 5/1986 | Donovan | 428/288 |
| 4,618,531 | 10/1986 | Marcus | 428/283 |
| 4,681,801 | 7/1987 | Elan et al. | 428/283 |

*Primary Examiner*—Lorraine T. Kendell

*Attorney, Agent, or Firm*—Kane, Dalsimer, Sullivan, Kurucz, Levy, Eisele & Richard

[57] ABSTRACT

This invention relates to synthetic fiber thermal insulator material in the form of a cohesive fiber structure, which structure comprises an assemblage of:

(a) from 70 to 95 weight percent of synthetic polymeric microfibers having a diameter of from 3 to 12 microns; and (b) from 5 to 30 weight percent of synthetic polymeric macrofibers having a diameter of 12 to 50 microns, characterized in that at least some of the fibers are bonded at their contact points, the bonding being such that the density of the resultant structure is within the range 3 to 16 kg/m$^3$, the thermal insulating properties of the bonded assemblage being equal to or not substantially less than the thermal insulating properties of a comparable unbonded assemblage. The invention also relates to the method of preparing said material.

10 Claims, 2 Drawing Sheets

SYNTHETIC DOWN

CROSS-REFERENCE TO RELATED APPLICATION

This application is a continuation-in-part of copending U.S. patent application Ser. No. 17,472, filed Feb. 20, 1987, now abandoned.

This invention relates to synthetic down and has particular reference to light-weight thermal insulation systems which can be achieved by the use of fine fibers in low density assemblies.

U.S. Pat. No. 4,588,635 describes and claims a synthetic fiber batt thermal insulator material which comprises a blend of (a) 80 to 95 weight percent of spun and drawn crimped, staple synthetic polymeric microfibers having a diameter of from 3 to 12 microns; and (b) 5 to 20 weight percent of synthetic polymeric staple macrofibers having a diameter of from more than 12 up to 50 microns, said batt having the following characteristics:

(i) a radiation parameter defined as the intercept on the ordinate axis at zero density of a plot of $K_C P_F$ against $P_E$ less than 0.173 (W/m-K) (kg/m$^3$) [0.075(Btu-in/hr-ft$^2$-°F.)(lb/ft$^3$)], (ii) a density $P_F$ from 3.2 9.6 lg/m$^3$ (0.2 to 0.6 1B/ft$^3$) and an apparent thermal conductivity $K_c$ measured by the plate to plate method according to ASTM C518 with heat flow down of less than 0.072 W/m-K (0.5 Btu-in/hr-ft$^2$-°F.).

This material approaches, and in some cases exceeds the thermal insulating properties of natural down.

From a mechanical standpoint, it is a matter of experience that extremely fine fibers suffer from deficiencies of rigidity and strength that make them difficult to produce, manipulate and use. Recovery properties of such a synthetic insulator material are enhanced at larger fiber diameters, but an increase in the large fiber component will seriously reduce the thermal insulating properties overall.

The problems associated with mechanical stability of fine fiber assemblies are exacerbated in the wet condition since surface tension forces associated with the presence of capillary water are considerably greater than those due to gravitational forces or other normal use loading and they have a much more deleterious effect on the structure.

Figure 1:
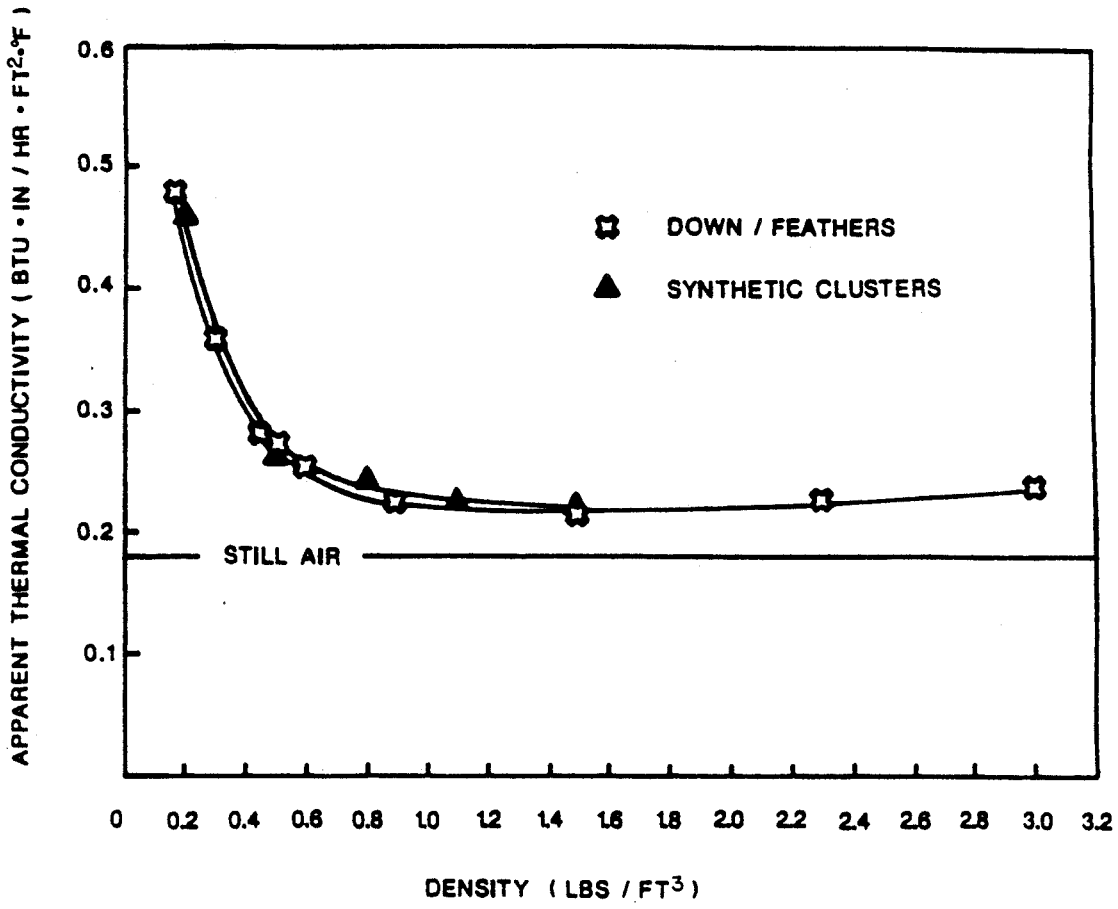
FIG. 1 is a plot of apparent thermal conductivity vs. density for several insulating materials.

According to the present invention there is provided a synthetic fiber thermal insulator material in the form of a cohesive fiber structure, which structure comprises an assemblage of:

(a) from 70 to 95 weight percent of synthetic polymeric microfibers having a diameter of from 3 to 12 microns; and (b) from 5 to 30 weight percent of synthetic polymeric macrofibers having a diameter of from 12 to 50 microns, characterized in that at least some of the fibers are bonded at their contact points, the bonding being such that the density of the resultant structure is within the range 3 to 16 kg/m$^3$ (0.2 to 1.0 lb/ft$^3$), the bonding being effected without significant loss of thermal insulating properties of the structure compared with the unbonded assemblage.

The invention also includes a method of forming a thermal insulating material which method comprises forming a fiber assemblage comprising:

(a) from 70 to 95 percent by weight of synthetic polymeric microfibers having a diameter of from 3 to 12 microns;

(b) from 5 to 30 percent by weight of synthetic polymeric macrofibers having a diameter not less than 12 microns;

(c) shaping the assemblage so formed, and effecting bonding between at least some of the fibers at their contact points such that the density of the resultant structure is within the range 3 to 16 kg/m$^3$(0.2 to 1.0 lb/ft$^3$); and (d) effecting bonding without significant loss of thermal insulating properties compared with the unbonded assemblage.

It is preferred that the resultant fiber assemblage has a radiation parameter defined as the intercept on the ordinate axis at zero density of a plot of $K_c P_F$ against $P_F$ less than 0.173 (W/m-K)(kg/m$^3$) [0.075 (Btu-in/hr-ft$^2$-°F.)(lb/ft$^3$)] and a density $P_F$ from 3.2 to 9.6 kg/m$^3$ (0.2 to 0.6 lb/ft$^3$) and an apparent thermal conductivity $K_c$ measured by the plate to plate method according to ASTM C518 with a heat flow down of less than 0.072 W/m-K (0.5 Btu-in/hr-ft$^2$-°F.).

Microfibers and macrofibers for use in the present invention may be manufactured from polyester, nylon, rayon, acetate, acrylic, modacrylic, polyolefins, spandex, polyaramids, polyimides, fluorocarbons, polybenzimidazols, polyvinylalcohols, polydiacetylenes, polyetherketones, polyimidazols, and phenylene sulphide polymers such as those commercially available under the trade name RYTON.

In general it is preferred that the microfibers are drawn following extrusion to impart tensile modulus of at least 63 g/dtex (70 g/den).

The bonding may be effected between at least some of the macrofibers to form a supporting structure for the microfibers, or may be between both macrofibers and some of the microfibers at their various contact points.

The macrofibers may be selected from the same material and may be either the same as the microfibers or different.

In one advantageous embodiment of the invention microfibers are formed from polyethylene terephthalate and the macrofibers are selected from the polyethylene terephthalate or a polyaramid, such, for example, as that commercially available under the trademark "Kevlar".

The macrofibers can be monofibers, i.e., fibers having a substantially uniform structure or may be multi-component fibers having a moiety to facilitate macrofiber to macrofiber bonding. The macrofiber may be a fiber mixture in which at least 10% by weight comprises macrofibers of a lower melting point thermoplastic material to assist the macrofiber to macrofiber bonding. In a further embodiment of the invention the macrofibers may be a fiber mixture comprising multi-component macrofibers and a monocomponent macrofiber capable of bonding one with the other.

In another embodiment of the present invention the macro component fiber may be a mix or blend of macrofibers having different properties, for example, a macro fiber mix may comprise two or more different fibers such as a polyester fiber to give the desired bonding and a "Kevlar" fiber to give stiffness. The proportion of stiffening fiber to bonding fiber may be varied to provide different properties subject to the requirement that the proportion of bondable fibers is sufficient for the macrofiber structure to provide an open support for the microfibers as hereinafter described.

Some materials, such as, for example, polyphenylene sulphide fibers, aromatic polyamides of the type commercially available under the trade name "APYIEL", and polyimide fibers such as those manufactured by Lenzing AG of Austria, exhibit flame retardant properties or are nonflammable. Such materials can, therefore, confer improved flame or fire resistant properties on manufactured products containing the materials in accordance with the present invention.

Methods of manufacturing such fibers are well known, see, for example, U.S. Pat. No. 4,148,103.

Useful two component fibers include type TJO4S2, a side-by-side polyester/polyester material and type TJO4C2, a sheath/core, polyester/polyester material, both available from Messrs. Teijin Ltd., of Japan.

The bonding in the structures in accordance with the invention is preferably, principally between the fibers of the macrofiber component at their contact points. The purpose of the macrofiber to macrofiber bonding is to form a supporting structure for the micro-fiber component, said supporting structure contributing significantly to the mechanical properties of the insulating material. By bonding the macrofibers, in accordance with the invention the macrofibers maintain an open bonded fiber structure within which the microfibers can be accommodated.

Any means of bonding between the macrofibers may be employed such, for example, as by the addition of solid, gaseous or liquid bonding agents whether thermoplastic or thermosetting or by the provision of autologous bonds in which the fibers are caused to bond directly through the action of an intermediary chemical or physical agent.

The method of bonding is not critical, subject only to the requirement that the bonding should be carried out under conditions such that the macrofiber component, does not lose its structural integrity. It will be appreciated by one skilled in the art that any appreciable change in the macro- or microfibers during bonding will affect the thermal properties adversely; the bonding step needs, therefore, to be conducted to maintain the physical properties and dimensions of the fiber components and the assemblage as much as possible.

The thermal insulating properties of the bonded assemblage are preferably substantially the same as, or not significantly less than, thermal insulating properties of a similar unbonded assemblage.

In a particular embodiment of the present invention bonding within the structure may be effected by heating the assemblage of fibers for a time and at a temperature sufficient to cause the fibers to bond. Such heating period may be at a temperature of from about 125° C. (257° F.) to 225° C. (437° F.) for a period of the order of 1 minute to 10 minutes and preferably at a temperature of from about 140° C. (284° F.) to 200° C. (392° F.) for a period of about 3 to 7 minutes; these periods are, of course, dependent upon the material of the macrofiber component.

The microfibers and optionally also the macrofibers constituting the assemblage of the invention may be crimped to assist in the production of a low density intimate blend or assemblage of the two components. Crimping techniques are well known in the art, but the average crimp number for both microfibers and macrofibers is preferably within the range of 3 to 8 crimps/cm (8 to 20 crimps/inch). The presence of crimp further assists re-establishment of loft in the fiber assembly after compression or wetting.

In a preferred embodiment the microfibers may have a tensile modulus of from 36 to 81 g/dtex (40 to 90 g/den). This relatively high tensile modulus contributes to a high bending modulus in the material of the invention and assists with the mechanical performance of the material in accordance with the invention.

In another embodiment of the present invention, lubricants may be included in one or both components of the assemblage. Typical lubricants are aqueous solutions of organopolysiloxanes, emulsions of polytetrafluoroethylene and non-ionic surfactants. Such lubricants may be applied to the fibers by spray or dip techniques well known in the art.

The assemblage of macrofibers and microfibers may be a batt consisting of plied card-laps although other fibrous forms such as air-laid webs are equally suitable. Webs and batts in which some fibers are oriented in the through-the-thickness direction as well as in the primary sheet plane are of distinct advantage from a mechanical performance standpoint. Webs of continuous filaments whether spun, bonded or otherwise produced may be used.

In another embodiment of the invention, the assemblage may be in the form of clusters or balls. Such clusters can be prepared by hand or through the use of commercially available machinery, such as automatic dicing, tumbling or ball-rolling machinery Batts or clusters in accordance with the invention may achieve densities comparable to the densities of natural down, i.e., of the order of less than 16 kg/m$^3$ (1.0 lb/ft$^3$) and typically about 8 kg/m$^3$ (0.5 lb/ft$^3$).

In cluster form, the insulator material of this invention surprisingly provides extremely good recovery from compressional loading. Furthermore, since it is compatible with current down processing equipment, it represents a viable synthetic down replacement material both from a performance and a processing standpoint.

Thermal insulating material in accordance with the present invention in the form of clusters tends to enjoy a more random orientation of the fibers, thus providing greater compressional recovery and more uniform properties. These clusters furthermore enjoy the advantage of being capable of being handled in established down handling and filling machinery. Such clusters may be made by shaping the fiber assemblage using a "cotton ball" rolling machine. Typical machines suitable for this purpose are manufactured by Bodolay/-Pratt Division of the Package Machinery Co., of Florida, U.S.A., and by Internationale Verbandstoff-Fabrik of Switzerland.

Following is a description by way of example only of methods of carrying the invention into effect In the following examples where reported the following tests were employed Density: The volume of each insulator sample was determined by fixing two planar sample dimensions and then measuring thickness at 0.014 kPa (0.002 lb/in$^2$) pressure. The mass of each sample divided by the volume thus obtained is the basis for density values reported herein.

Thickness was measured at 0.014 kPa (0.002 lb/in$^2$).

Apparent thermal conductivity was measured in accord with the plate/sample/plate method described by ASTM Method C518.

Radiation Parameter, C, was calculated from the expression $$C = K_c P_F - K_a P_F$$

where $K_c$=apparent thermal conductivity of the material, $p_F$ = density of the material, and $k_a$ = the thermal conductivity of still air, = 0.025 $W/m - K$ (0.175 Btu-in/hr-ft$^2$-°F.).

Compressional Strain: Strain at 34.4 kPa (5 lb/in$^2$), which was the maximum strain in the compressional recovery test sequence, was recorded for each test.

Compressional Recovery and Work of Compression and Recovery: Section 4.3.2 of Military Specification MIL-B-41826E describes a compressional-recovery test technique for fibrous batting that was adapted for this work. The essential difference between the Military Specification method and the one employed is the lower pressure at which initial thickness and recovered-to-thickness were measured. The measuring pressure in the Specification is 0.07 kPa (0.01 lb/in$^2$) whereas 0.014 kPa (0.002 lb/in$^2$) was used in this work.

Water Absorption Capacity: ASTM Method D1117 provided the starting point for development of the water absorption-capacity and absorption-time test used. However, wetted sample weighings were made at frequent intervals during the first six hours of immersion and another weighing was made after twenty-four hours (Method D1117 requires only one wetted sample weighing). A unique sample-holder and a repeatable technique for draining excess water prior to each weighing were adopted after some initial experimentation.

Drying Time: After each absorption capacity test, weighings were made at one-half hour intervals as the sample air-dried on a wire rack in a 21° C. (70° F.), 65% r.h. atmosphere.

Batt Cohesiveness: A 5.1 cm (2 inch) thick, 14.5 cm (5.7 inch) diameter circular test-specimen was cut from each batt. Each specimen was gripped so that it could be pulled apart in the direction perpendicular to the batt plane, i.e., tensile tested in the through-the-thickness direction. Results were recorded in terms of tensile strain at the time of initial batt separation and expressed as extension ratios, which are defined as the ratio of the batt thickness at separation or disruption to the original batt thickness under zero applied load.

Cluster Cohesiveness Individual clusters weighing 60 mg and having diameters of 3.05 to 3.15 cm (1.20 to 1.25 inches) were mounted in light-weight spring-action jaws in a tensile test machine. The jaw faces were lined with rubber and measured 0.64×0.64 cm (0.25×0.25 inches); they were spaced to provide an initial separation (gauge length) of 1.19 cm (0.75 inch). The maximum force attained as each cluster was drawn apart and fully separated was recorded.

The down used throughout the examples was actually a down/feathers mixture, 80/20 by weight, per MIL-F-43097G, Type II, Class I. This mixture is commonly and commercially referred to as "down" and is referred to as "down" herein.

EXAMPLES

Comparative Example 1

Consistent with U.S. Pat. No. 4,588,635 a quantity of spun and drawn 3.05 cm (1.2 inch) long microfibers having a diameter of 7.5 microns was provided. The fibers were lubricated with a silicone finish. The spun-and-drawn microfibers were polyester and were drawn to achieve a relatively high tensile modulus 54–81 g/dtex (60–90 g/den), which contributed significantly to a high bending modulus. After drawing they were crimped, cut into staple, and thoroughly opened, or separated, in a card. The average crimp frequency was 5.5/cm (14/in), and the average crimp amplitude was 0.10 cm (0.04 in). Loft and compressional characteristics were improved further through the blending with 10 percent by weight of macrofibers of the same polyester (polyethylene teraphthalate) having a diameter of 25.5 microns. The macrofibers were lubricated with a silicone finish and were characterized in part by a staple length of 5.6 cm (2.2 in), an average crimp frequency of 3.4/cm (8.5/in), and a crimp amplitude (average) of 0.15 cm (0.06 in). The blend was carded into a batt. The physical properties of the batt are shown in Table I below.

Comparative Example 2

The procedure of Comparative Example 1 was repeated with the exception that the macrofiber used therein was replaced with 20 percent by weight of uncrimped poly(p-phenylene teraphthalamide) fibers having a diameter of 12 microns, a length of 7.6 cm (3.0 in), and a silicone lubricant finish. The physical characteristics of the material formed are given in Table I below.

Example 1

A quantity of 0.55 dtex (0.5 denier) 7.5 micron diameter polyester microfiber that had been spun, drawn, cut to a staple length of 3.0 cm (1.2 in) and crimped was first opened in a wire-clothed carding machine The opened fiber was then scoured, dried, and treated with a silicone finish that imparts lubricity and water repellency. The microfiber was then combined and uniformly blended with a 4.4 dtex, 5.1 cm (4 denier, 2 in) long polyester binder fiber of the side-by-side type (Type TJ04S2, available from Teijin). Blending was achieved by subjecting the mixed fiber stock to several passes through a carding machine. The mixture ratio was 90/10, microfiber/binder macrofiber, by weight. After the mixed fibers had been uniformly blended and opened, card laps (output webs from the carding machine) were plied to form batts. The final processing step was oven exposure of the batts at 160° C. (320° F.) for 5 minutes to obtain thermoplastic bonds between microfibers and binder macrofibers and between binder macrofibers. These bonds ensured that each batt was a cohesive, non-separable fibrous assembly.

The prepared batts were evaluated in accord with the test procedures described above and the results are set forth in Table I below.

Example 2

A quantity of 0.55 dtex (0.5 denier) 7.5 micron diameter polyester microfiber that had been spun, drawn, cut to a staple length of 3.0 cm (1.2 in), and crimped was first opened in a wire-clothed carding machine. The opened fiber was then scoured, dried and treated with a silicone finish that imparts lubricity and water repellency The microfiber was then combined and uniformly blended with 4.4 dtex, 5.1 cm (4 denier, 2 in) long, polyester binder fiber of the side-by-side type (Type TJO4S2, available from Teijin). Blending was achieved by subjecting the mixed fiber stock to several passes through a carding machine. The mixture ratio was 90/10, microfiber/binder macrofiber, by weight. After the mixed fibers had been uniformly blended and opened, the card lap (output of the carding machine) was separated into clusters. These clusters were more or less spherical in shape with an average diameter of 1.91 cm (0.75 in), and an average weight of 15 mg. Cluster formation was achieved in the laboratory through hand manipulation, although at least two commercial processes for transforming carded fibers into clusters or balls are known. The final processing step was oven exposure of the down-like clusters to a temperature of 160° C. (320° F.) for 5 minutes to obtain thermoplastic bonds between microfibers and binder macrofibers and between binder macrofibers. These bonds made each individual cluster a cohesive, non-separable unit.

The prepared clusters were evaluated in accord with the test procedures described above and the results are set forth in Table I below.

Example 3

A quantity of 0.55 dtex (0.5 denier) 7.5 micron diameter polyester microfiber that had been spun, drawn, cut to a staple length of 3.0 cm (1.2 in), and crimped was first opened in a wire-clothed carding machine. The opened fiber was then scoured, dried, and treated with a silicone finish that imparts lubricity and water repellency. The microfiber was then combined and uniformly blended with 4.4 dtex, 5.1 cm (4 denier, 2 in) long, polyester binder fiber of the side-by-side type (Type TJO4S2, available from Teijin). Blending was achieved by subjecting the mixed fiber stock to several passes through a carding machine. The mixture ratio was 85/15, microfiber/binder macrofiber by weight. After the mixed fibers had been uniformly blended and opened, card laps (output webs from the carding machine) were plied to form batts. The final processing step was oven exposure of the batts at 160° C. (320° F.) for 5 minutes to obtain thermoplastic bonds between microfibers and binder macrofibers and between binder macrofibers. These bonds ensured that each batt was a cohesive, non-separable fibrous assembly.

The prepared batts were evaluated in accord with the test procedures described above and the results are set forth in Table I below.

The insulator produced in this example was used to manufacture jackets, sleeping bags and quilts. All were found to have and maintain thermal insulating performance equivalent to or better than those using down as the insulator.

Example 4

A quantity of 0.55 dtex (0.5 denier), 7.5 micron diameter polyester microfiber that had been spun, drawn, cut to staple length of 3.0 cm (1.2 in), and crimped was first opened in a wire-clothed carding machine. The opened fiber was then scoured, dried, and treated with a silicone finish that imparts lubricity and water repellency. The microfiber was then combined and uniformly blended with 4.4 dtex, 5.1 cm (4 denier, 2 in) long, polyester binder fiber of the side-by-side type (Type TJ04S2, available from Teijin). Blending was achieved by subjecting the mixed fiber stock to several passes through a carding machine. The mixture ratio was 85/15 microfiber/binder macrofiber, by weight. After the mixed fiber had been uniformly blended and opened, the card lap (output of the carding machine) was separated into clusters. These clusters were more or less spherical in shape with an average diameter of 1.91 cm (0.75 in) and an average weight of 15 mg. Cluster formation was achieved in the laboratory through hand manipulation, although at least two commercial processes for transforming carded fibers into clusters or batts are known. The final processing step was oven exposure of the down-like clusters to a temperature of 160° C. (320° F.) for 5 minutes to obtain thermoplastic bonds between microfibers and binder macrofibers and between binder macrofibers. These bonds made each individual cluster a cohesive, non-separable unit.

The prepared clusters were evaluated in accord with the test procedures described above and the results are set forth in Table I below.

Example 5

A quantity of 0.55 dtex (0.5 denier), 7.5 micron diameter polyester microfiber that had been spun, drawn, cut to a staple length of 3.0 cm (1.2 in), and crimped was first opened in a wire-clothed carding machine. The opened fiber was then scoured, dried, and treated with a silicone finish that imparts lubricity and water repellency. The microfiber was then combined and uniformly blended with 4.4 dtex, 5.1 cm (4 denier, 2 in) long, polyester binder fiber of the side-by-side type (Type TJO4S2, available from Teijin). Blending was achieved by subjecting the mixed fiber stock to several passes through a carding machine. After the mixed fibers had been uniformly blended and opened, card laps (output webs from the carding machine) were plied to form batts. The final processing step was oven exposure of the batts at 160° C. (320° F.) for 5 minutes to obtain thermoplastic bonds between microfibers and binder macrofibers and between binder macrofibers. These bonds ensured that each batt was a cohesive, non-separable fibrous assembly.

The prepared batts were evaluated in accord with the test procedures described above and the results are set forth in Table I below.

Example 6

A quantity of 0.55 dtex (0.5 denier) 7.5 micron diameter polyester microfiber that had been spun, drawn, cut to a staple length of 3.0 cm {1.2 in), and crimped was first opened in a wire-clothed carding machine. The opened fiber was then scoured, dried, and treated with a silicone finish that imparts lubricity and water repellency. The microfiber was then combed and uniformly blended with 4.4 dtex, 5.1 cm (4 denier, 2 in) long, polyester binder fiber of the side-by-side type (Type TJO4S2, available from Teijin). Blending was achieved by subjecting the mixed fiber stock to several passes through a carding machine. The mixture ratio was 80/20, microfiber/binder macrofiber, by weight. After the mixed fibers had been uniformly blended and opened, the card lap (output of the carding machine) was separated into clusters. These clusters were more or less spherical in shape with an average diameter of 1.91 cm (0.75 in) and an average weight of 15 mg. Cluster formation was achieved in the laboratory through hand manipulation.

The final processing step was oven exposure of the down-like clusters to a temperature of 160° C. (320° F.) for 5 minutes to obtain thermoplastic bonds between microfibers and binder macrofibers and between binder macrofibers. These bonds made each individual cluster a cohesive, nonseparable unit.

The prepared clusters were evaluated in accord with the test procedures described above and the results are set forth in the following table:

of Example 2 are seen to be nearly coincident. It can be seen from Table I that the mechanical performance of Examples 1 through 6, as characterized by minimum density, compressional strain, compressional recovery, work to compress, and resilience, compares favorably in most instances to the mechanical performance of the down/feathers mixture and Comparative Examples 1 and 2.

Differences do exist, however, among values for two important mechanical performance indicators those of minimum density (loft) and compressional recovery.

TABLE I

| | Down | Comparative Example 1 | Comparative Example 2 | Example 1 (Batt, 90/10) | Example 2 Clusters 90/10 | Example 3 Batt 85/15 | Example 4 Clusters 85/15 | Example 5 Batt 80/20 | Example 6 Clusters 80/20 |
|---|---|---|---|---|---|---|---|---|---|
| Apparent thermal conductivity | | | | | | | | | |
| W/m-K | 0.040 | 0.040 | 0.039 | 0.039 | 0.038 | 0.042 | 0.039 | 0.042 | 0.041 |
| (Btu-in/hr-ft$^2$-°F.) | (0.280) | (0.281) | (0.271) | (0.269) | (0.264) | (0.291) | (0.268) | (0.291) | (0.286) |
| Thermal cond. test | | | | | | | | | |
| density kg/m$^3$ | 7.21 | 7.53 | 7.69 | 8.01 | 8.02 | 8.02 | 8.02 | 8.02 | 8.02 |
| (lb/ft$^3$) | (0.45) | (0.47) | (0.48) | (0.50) | (0.50) | (0.50) | (0.50) | (0.50) | (0.50) |
| Radiation parameter, C | | | | | | | | | |
| (W/m-K) (kg/m$^3$) ($10^{-2}$) | 10.8 | 11.5 | 10.6 | 10.8 | 10.2 | 13.4 | 10.6 | 13.4 | 12.9 |
| [(Btu-in/hr-ft$^2$-°F.) | (4.7) | (5.0) | (4.6) | (4.7) | (4.4) | (5.8) | (4.6) | (5.8) | (5.6) |
| (lb/ft$^3$)($10^{-2}$)] | | | | | | | | | |
| Minimum density kg/m$^3$ | 3.85 | 4.01 | 4.01 | 6.89 | 4.17 | 7.37 | 4.17 | 6.25 | 3.85 |
| (lb/ft$^3$) | (0.24) | (0.25) | (0.25) | (0.43) | (0.26) | (0.46) | (0.26) | (0.39) | (0.24) |
| Comp. strain at 34.4 kPa (5 lb/in$^2$) %[b] | 95 | 96 | 92 | 97 | 95 | 96 | 95 | 96 | 95 |
| Comp. recovery from 34.4 kPa (5 lb/in$^2$) %[b] | 102 | 112 | 112 | 83 | 130 | 81 | 135 | 87 | 132 |
| Work to compress to 34.4 kPa N-m | 0.55 | 0.39 | 0.40 | 0.36 | 0.54 | 0.35 | 0.54 | 0.34 | 0.52 |
| (5 lb/in$^2$) (lb-in) | (4.91) | (3.49) | (3.57) | (3.21) | (4.75) | (3.13) | (4.76) | (3.01) | (4.56) |
| Resilience[c] | 0.53 | 0.62 | 0.60 | 0.59 | 0.44 | 0.58 | 0.43 | 0.61 | 0.46 |
| Wetting during Immersion | | | | | | | | | |
| Water absorption after 20 min. (x dw)[d] | 1.16 | 2.16 | 1.41 | 1.09 | 1.61 | 1.04 | 1.14 | 1.08 | 1.06 |
| Density after 20 min wetting kg/m$^3$ | 7.69 | 8.02 | 8.17 | 8.49 | 6.89 | 8.17 | 5.13 | 8.02 | 4.49 |
| (lb/ft$^3$) | (0.48) | (0.50) | (0.51) | (0.53) | (0.43) | (0.51) | (0.32) | (0.50) | (0.28) |
| Water absorption after 6 hr (x dw) | 3.75 | 5.15 | 3.44 | 1.42 | 2.96 | 1.75 | 2.03 | 1.39 | 1.41 |
| Density after 6 hr wetting kg/m$^3$ | 56.91 | 15.07 | 16.35 | 11.86 | 14.43 | 15.39 | 10.26 | 10.90 | 6.89 |
| (lb/ft$^3$) | (3.55) | (0.94) | (1.02) | (0.74) | (0.90) | (0.96) | (0.64) | (0.68) | (0.43) |
| Drying after 24 hrs. Water Immersion | | | | | | | | | |
| Weight after 30 min drying (x dw) | 3.88 | 4.83 | 3.29 | 1.27 | 2.79 | 1.53 | 1.87 | 1.27 | 1.35 |
| Density after 30 min drying (kg/m$^3$) | 83.37 | 15.23 | 14.43 | 9.94 | 12.98 | 13.65 | 8.49 | 9.94 | 6.57 |
| (lb/ft$^3$) | (5.20) | (0.95) | (0.90) | (0.62) | (0.81) | (0.84) | (0.53) | (0.62) | (0.41) |
| Weight after 6 hr drying (x dw) | 2.45 | 1.68 | 1.01 | 1.0 | 1.92 | 1.0 | 1.0 | 1.0 | 1.0 |
| Density after 6 hr drying kg/m$^3$ | 51.30 | 6.57 | 7.05 | 7.85 | 8.82 | 7.85 | 4.49 | 7.37 | 4.33 |
| (lb/ft$^3$) | (3.20) | (0.41) | (0.44) | (0.49) | (0.55) | (0.49) | (0.28) | (0.46) | (0.27) |

[a]Heat flow down: 5.23 cm (2.06 inches) specimen thickness
[b]Gauge length: 5.1 cm (2.00 inches); density at this thickness was 8.02 kg/m$^3$ (0.50 lb/ft$^3$).
[c]Resilience equals: work-of-recovery divided by work-to-compress.
[d]x dw: times dry weight.

It can be seen from the above Table I that the insulating efficiency of each of Examples 1 through 6 of the invention, as characterized by apparent-thermal-conductivity data and radiation parameter values, closely approximates that of the down/feathers mixture and of Comparative Examples 1 and 2. The insulating value of material produced in accord with the invention, as exemplified by Example 2, is further illustrated in FIG. 1, in which the apparent thermal conductivity/density diagrams for down/feathers and the synthetic clusters The minimum density and compressional recovery values for the batts of Examples 1, 3 and 5 indicate inferior performance compared to down/feathers and Comparative Examples 1 and 2, while the compressional recovery values for the cluster forms of Examples 2, 4 and 6 indicate significant performance improvement over down/feathers. The minimum density (loft) values for the cluster forms are virtually equal to those of down-/feathers and non-bonded Comparative Examples 1 and 2. This mechanical performance advantage of the synthetic clusters is a direct consequence of difference in fiber orientation. An aggregation of clusters like those of Examples 2, 4 and 6 (and as would be employed in a typical insulator application) constitutes a collection of fibers of random orientation. This is in distinct contrast to the ordered fiber orientation of the batt form. A large fraction of the fibers that comprise each batt lie more or less parallel to the plane of the batt, contributing relatively little to its loftiness and compressional elasticity. In the cluster form, the random fiber alignment provides some fibers that are perpendicular to, or nearly perpendicular to, the insulator plane. These fibers are, in effect, structural columns. They improve the loftiness of the assembly and, through elastic bending and/or buckling, greatly enhance the compressional recovery of the insulator.

Further examination of Table I makes clear the considerable improvement in performance during and following water exposure that further distinguishes Examples 1 through 6 in comparison to the down/feathers mixture. Density values for Examples 1 through 6 at the "6 hr. wetting", "30 min. drying", and "6 hr. drying" intervals in the wetting/drying cycle are much lower than those for down/feathers, indicating that Examples 1 through 6 retain loft while wet and, most probably, insulating value to a far greater degree than does down. Resistance-to-wetting and resistance to loss-of-loft while wet are inherent advantages of the fiber combination described herein. The hydrophobic nature of polyester and the microporous structure of the insulators are assumed to contribute to these desirable characteristics.

Several further comparative examples were prepared for the purpose of documenting the insulator stability and cohesiveness that was manifest through examination and handling of Examples 1 through 6, above. These comparative examples were as follows:

Comparative Example 3

The procedure of Example 1 was repeated to produce another batt having a fiber mixture ratio of 90/10, microfiber/binder macrofiber by weight. However, the final processing step described for Example 1, oven exposure, was omitted to provide a non-bonded batt for comparative purposes.

Comparative Example 4

The procedure of Example 5 was repeated to produce another batt having a fiber mixture ratio of 80/20, microfiber/binder macrofiber by weight. However, the final processing step described for Example 5, oven exposure, was omitted to provide a non-bonded batt for comparative purposes.

Comparative Example 5

The basic procedure of Example 4 was repeated to produce another collection of clusters having a fiber mixture ratio of 85/15 microfiber/binder macrofiber, by weight, with the exception that the final oven exposure step was omitted. The clusters produced differed from those of Example 4 in that their average diameter was 3.0 cm (1.2 in), their average weight was 60 mg, and they were not bonded.

An additional example of the subject invention was also prepared to further facilitate documentation of the stability and cohesiveness of insulating media made according to the invention. This example was as follows:

Example 7

The basic procedure of Example 4 was repeated to produce another collection of clusters having a fiber mixture ratio of 85/15, microfiber/binder macrofiber, by weight. The clusters produced differed from those of Example 4 only in size and weight. The clusters of this example, like those of Comparative Example 5, had an average diameter of 3.0 cm (1.2 in), and an average weight of 60 mg. The clusters of the present example were, however, subjected to oven exposure at 160° C. (320° F.) for 5 minutes to obtain thermoplastic bonds between microfibers and binder macrofibers and between binder macrofibers.

Insulating batts of Examples 1 and 5 of the subject invention and Comparative Examples 3 and 4 were evaluated, the batt cohesiveness test previously herein described being used, and the results are set forth in the following table:

TABLE II

Extension Ratios Measured at the Point of Initial Batt Separation in Through the Thickness Tensile Tests

| | Extension Ratios |
|---|---|
| Comparative Example 3; 90/10; non-bonded | 3:1 |
| Example 1; 90/10; bonded | 12:1 |
| Comparative Example 4; 80/20; non-bonded | 3:1 |
| Example 5 80/20; bonded | 16:1 |

It will be understood from the above descriptions of the examples and comparative examples (1) that the batts of Example 1 and Comparative Example 3 are alike in terms of types of fibers and proportional quantities of fibers that they contain and (2) that they differ in that only the batt of Example 1 has been subjected to over exposure to achieve fiber-to-fiber bonding. Similarly, the batts of Example 5 and Comparative Example 4 are alike in basic composition but differ in that only Example 5 contains fiber-to-fiber bonds.

The important effect of fiber-to-fiber bonding upon the cohesiveness of batts of the subject invention, specifically upon that of Examples 1 and 5, is shown by the high extension ratios measured at the point of initial batt separation and set forth in Table II. The high extension ratios of these embodiments are in direct contrast to the low ratios measured for Comparative Examples 3 and 4 (also set forth in Table II).

In corresponding fashion, the importance of fiber-to-fiber bonds to the cohesiveness and integrity of individual clusters is exemplified through comparison of the average separation force measured for clusters of Example 7 with the average force measured for those of Comparative Example 5, as set forth in the following table:

TABLE III

Tensile Force Required to Pull Apart Clusters

| | Average Force (gms) |
|---|---|
| Comparative Example 5; 85/15; non-bonded | 3 |
| Example 7; 85/15; bonded | 41 |

The results shown above represent a surprisingly high 13.7 × increase in average cluster separation force.

Examples 8 to 13

Bonded structures were produced in the manner described in Example 1 using a mix of macrofibers. In each example the microfibers are a 0.55 dtex (0.5 denier) polyester fiber. The macrofibers were a blend of 4.4 dtex(4 denier) polyester binder fiber as described in Example 1 with a 1.5 dtex (1.4 denier) stiffening fiber of "Kevlar 49".

The results are set out in Table IV. The percentages given of constituents at the head of each example column are percent by weight; the first figure is the percent by weight of microfibers (polyester), the second figure is the percent by weight of polyester macrofiber, and the third figure is the percent by weight of "Kevlar" stiffening fiber. Thus, 80/10/10 has the composition:

| | |
|---|---|
| 0.55 dtex (0.5 denier) polyester microfiber | 80 percent by wt. |
| 4.4 dtex (4 denier) polyester macrofiber | 10 percent by wt. |
| 1.5 dtex (1.4 denier) "Kevlar 49" stiffening fiber | 10 percent by wt. |

TABLE IV

| | | Example 8 Batt 80/10/10 | Example 9 Clusters 80/10/10 | Example 10 Batt 75/15/10 | Example 11 Clusters 75/15/10 | Example 12 Batt 70/20/10 | Example 13 Clusters 70/20/10 |
|---|---|---|---|---|---|---|---|
| Apparent thermal conductivity | | | | | | | |
| W/m-K | | 0.041 | — | 0.043 | — | 0.044 | — |
| (Btu-in/hr-ft$^2$-°F.) | | (0.283) | | (0.296) | | (0.303) | |
| Thermal cond. test density kg/m$^3$ | | 8.02 | 8.02 | 8.02 | 8.02 | 8.02 | 8.02 |
| (lb/ft$^3$) | | (0.50) | (0.50) | (0.50) | (0.50) | (0.50) | (0.50) |
| Radiation parameter, C (W/m-K)(kg/m$^3$) | | | | | | | |
| ($10^{-2}$) | | 12.5 | — | 13.8 | — | 14.8 | — |
| [(Btu-in/hr-ft$^2$-°F.) | | (5.4) | | (6.0) | | (6.4) | |
| (lb/ft$^3$)($10^{-2}$)] | | | | | | | |
| Minimum density kg/m$^3$ | | 6.57 | 4.01 | 7.05 | 4.17 | 6.09 | 3.85 |
| (lb/ft$^3$) | | (0.41) | (0.25) | (0.44) | (0.26) | (0.38) | (0.24) |
| Comp. strain at 34.4 kPa (5 lb/in$^2$) | %[b] | 96 | 95 | 95 | 95 | 95 | 95 |
| Comp. recovery from 34.4 kPa (5 lb/in$^2$) | %[b] | 86 | 125 | 87 | 120 | 89 | 117 |
| Work to compress to 34.4 kPa N-m | | 0.41 | 0.40 | 0.38 | 0.44 | 0.38 | 0.52 |
| (5 lb/in$^2$)(lb-in) | | (3.60) | (3.57) | (3.34) | (3.86) | (3.41) | (4.56) |
| Resilience | | 0.66 | 0.76 | 0.58 | 0.56 | 0.58 | 0.50 |

[a]Heat flow down: 5.23 cm (2.06 inches) specimen thickness.
[b]Gauge length: 5.1 cm (2.00 inches); density at this thickness was 8.02 kg/m$^3$ (0.50 lb/ft$^3$).
[c]Resilience equals: work-of-recovery divided by work-to-compress.
[d]x dw: times dry-weight.

Mention is made above of the radiation parameter. Measured values of the radiation parameter for a wide range of polymeric fiber assemblies, as well as other details for these fibers, are set forth in the following Table V:

TABLE V

| | Values of the Radiation Parameter C | | | |
|---|---|---|---|---|
| | Density $P_f$ | Denier | Diameter d (μ) | Radiation Parameter C* |
| Down | 1.30 | — | 2.5–11.0 | $4.8 \times 10^{-2}$ |
| Albany Res. Co. PET | 1.38 | 0.5 | 7.5 | 4.2 |
| Teijin PET | 1.38 | 0.8 | 10 | 5.2 |
| DuPont D102 PET | 1.38 | 1.6 | 13 | 7.0 |
| Celanese Polarguard PET | 1.38 | 5 | 23 | 10.1 |
| Hollofil 808 PET | 1.17 | 5.5 | 26 | 11.8 |
| Hollofil II PET | 1.17 | 5.5 | 26 | 11.4 |
| Hollofil 91 PET | 1.17 | 15 | 42 | 14.5 |
| Melt-blown polyolefin | 0.90 | — | 1–3 | 9.4 |
| Melt-blown PET | 1.38 | — | 1–3 | 8.1 |
| Hollofil II($\epsilon_o = \epsilon_L = .05$) | 1.17 | 5.5 | 26 | 8.7 |
| Kevlar 49 | 1.4 | 1.4 | 12 | 8.4 |
| Black PET | 1.38 | 4.5 | 21 | 13.0 |

*(Btu-in/hr ft$^2$ °F.) (lb/ft$^3$)

Figure 2:
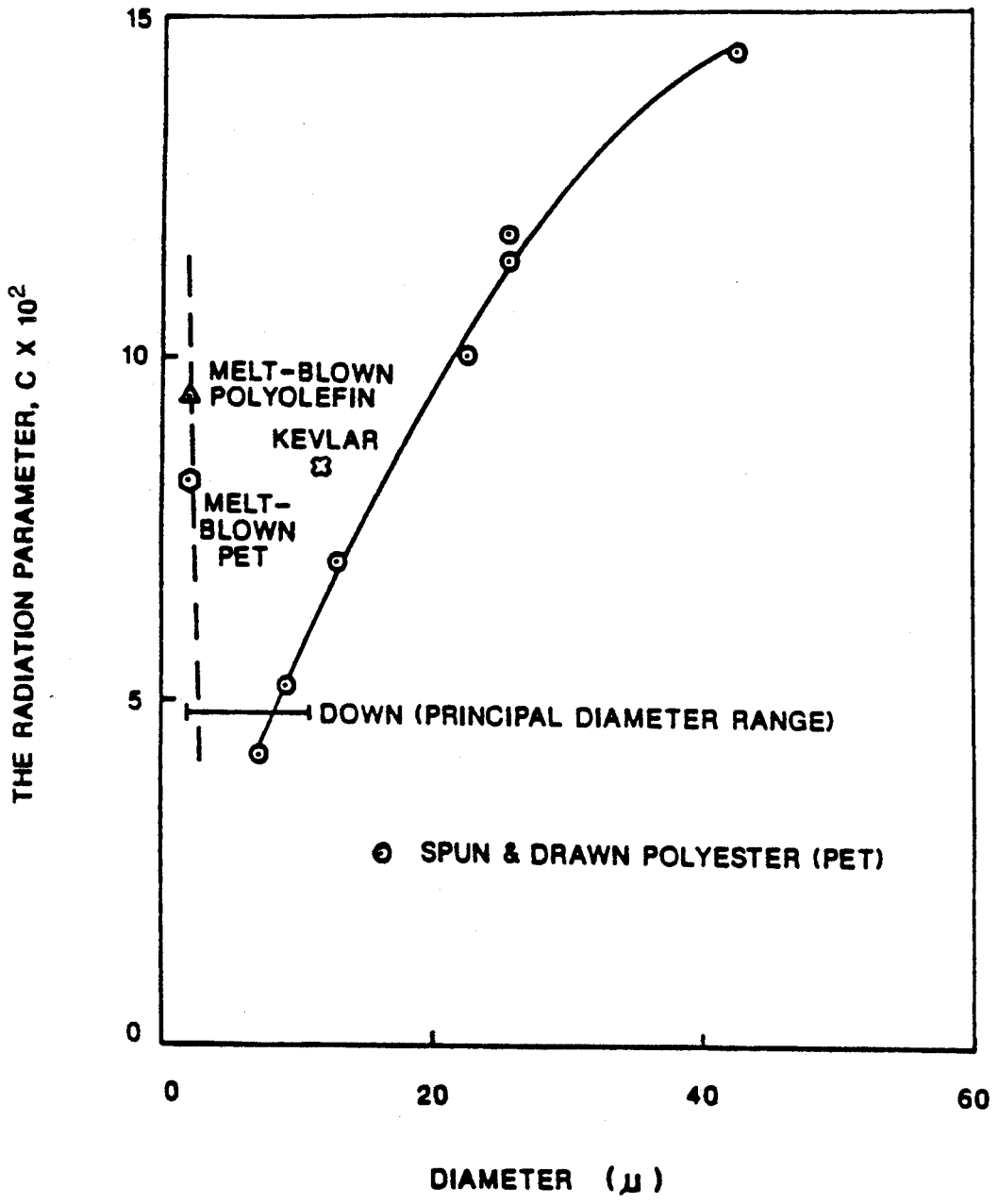
FIG. 2 represents a plot of the radiation parameter vs. fiber diameter for several different insulating materials.

Also, FIG. 2 represents a plot of the radiation parameter against fiber diameter. The general tendency that is clear from the experimental results is that the radiation parameter is reduced as the fiber diameter is decreased, with the result that the effective thermal resistance of the assembly is increased. It is equally clear, however, that this reduction in fiber diameter is not beneficial without limit, since the samples of fiber assemblies containing microfibers show a sharp increase in radiation parameter.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A synthetic fiber thermal insulator material in the form of a cohesive fiber structure, which structure comprises an assemblage of:

(a) from 70 to 95 weight percent of spun and drawn, synthetic polymeric microfibers having a diameter of from 3 to 12 microns; and (b) from 5 to 30 weight percent of synthetic polymeric macrofibers having a diameter of 12 to 50 microns, characterized in that at microfiber/macrofiber contact points said microfibers are bonded to said macrofibers and at macrofiber/macrofiber contact points said macrofibers are bonded to said macrofibers, the bonding being such that the macrofiber component does not lose its structural integrity and the density of the resultant structure is within the range of 0.2 to 1.0 lb/ft$^3$, the thermal insulating properties of the bonded assemblage being equal to or not substantially less than the thermal insulating properties of a comparable unbonded assemblage, and in that said material has a radiation parameter defined as the intercept on the ordinate axis at zero density of a plot of $K_cP_f$ against $P_f$ less than 0.075 (Btu-in/hr-ft$^2$-°F.) (lb/ft$^3$) and an apparent thermal conductivity $K_c$ measured by the plate-to-plate method according to ASTM C518 with heat flow down of less than 0.5 Btu-in/hr-ft$^2$-°F.

2. A synthetic fiber thermal insulator material in the form of a cohesive fiber structure, which structure comprises an assemblage of:

(a) from 70 to 95 weight percent of spun and drawn, synthetic polymeric microfibers having a diameter of from 3 to 12 microns; and (b) from 5 to 30 weight percent of synthetic polymeric macrofibers having a diameter of 12 to 50 microns, characterized in that the majority of said macrofibers are bonded at their contact points thereby forming a supporting structure for said microfibers, the bonding being such that the macrofiber component does not lose its structural integrity and the density of the resultant structure is within the range of 0.2 to 1.0 lb/ft$^3$, the thermal insulating properties of the bonded assemblage being equal to or not substantially less than the thermal insulating properties of a comparable unbonded assemblage, and in that said material has a radiation parameter defined as the intercept on the ordinate axis at zero density of a plot of $K_cP_f$ against $P_f$ less than 0.075 (Btu-in/hr-ft$^2$-°F.)(lb/ft$^3$) and an apparent thermal conductivity $K_c$ measured by the plate-to-plate method according to ASTM C518 with heat flow down of less than 0.5 Btu-in/hr-ft$^2$-°F.

3. A material as claimed in claim 1 characterized in that the microfiber is selected from one or more of polyester, nylon, rayon, acetate, acrylic, modacrylic, polyolefins, spandex, polyaramids, polyimides, fluorocarbons, polybenzimidazols, polyvinylalcohols, polydiacetylenes, polyetherketones, polyimidazols and phenylene sulphide polymers.

4. A material as claimed in claim 1 characterized in that the macrofiber is selected from one or more of polyester, nylon, rayon, acetate, acrylic, modacrylic, polyolefins, spandex, polyaramids, polyimides, fluorocarbons, polybenzimidazols, polyvinylalcohols, polydiacetylenes, polyetherketones, polyimidazols and phenylene sulfide polymers.

5. A material as claimed in claim 1 characterized in that the macrofiber is selected from one or more of:

(i) multi-component fibers having a moiety of facilitate macrofiber to macrofiber bonding;

(ii) a fiber mixture in which at least 10% by weight of the macrofibers comprise macrofibers of a low melting point material; and (iii) a fiber mixture comprising multi-component macrofibers and single component macrofibers capable of bonding one with the other.

6. A material as claimed in claim 5 characterized in that multi-component macrofibers are selected from two component fibers in a side-by-side construction as in a sheath/core construction.

7. A material as claimed in claim 1 characterized i n that at least one of the fibrous components has a water repellent finish, a lubricant finish, or a water repellent and lubricant finish.

8. A material as claimed in claim 1 characterized in that the microfibers, the macrofibers, or the microfibers and the macrofibers are crimped.

9. A material as claimed in claim 1, wherein the material is in the form of batts.

10. A material as claimed in claim 1, wherein the material is in the form of clusters.

* * * * *